United States Patent [19]

Thery et al.

[11] 4,194,572

[45] Mar. 25, 1980

[54] FIRE EXTINGUISHING APPARATUS FOR LARGE OIL STORAGE RESERVOIRS

[75] Inventors: Jean P. Thery, Le Chesnay; Claude M. Alban, Charenton; Albert P. Jordi, La Caviere d'Azur, all of France

[73] Assignee: Compagnie Francaise des Petroles, S.A., Paris, France

[21] Appl. No.: 682,932

[22] Filed: May 4, 1976

[30] Foreign Application Priority Data

May 6, 1975 [FR] France ..... 75 14078

[51] Int. Cl.[2] ..... A62C 35/00

[52] U.S. Cl. ..... 169/66; 169/9; 169/17

[58] Field of Search ..... 169/66, 67, 68, 5, 9, 169/16, 17, 20, 22, 26, 35, 57, 56–59

[56] References Cited

U.S. PATENT DOCUMENTS

| | | | |
|---|---|---|---|
| 1,862,686 | 6/1932 | Knight | 169/17 X |
| 2,399,553 | 4/1946 | Lindsay et al. | 169/16 X |
| 3,113,624 | 12/1963 | Haggott et al. | 169/5 |
| 3,401,751 | 9/1968 | Loftin et al. | 169/17 |
| 3,827,502 | 8/1974 | Lockwood | 169/35 X |

*Primary Examiner*—John J. Love

*Attorney, Agent, or Firm*—Sughrue, Rothwell, Mion, Zinn and Macpeak

[57] ABSTRACT

A fire extinguishing apparatus particularly but not exclusively for protecting large areas comprising a reservoir for a fire extinguishing fluid under pressure connected by a normally closed differential valve to a plastics tube which traverses the area to be protected, the tube being filled with air and/or an inert gas under pressure and being adapted to burst when exposed to a predetermined temperature, bursting of the tube and the consequent sudden decrease in pressure in the tube causing opening of the valve to allow the extinguishing fluid to flow from the reservoir along the tube to the region of the burst.

11 Claims, 6 Drawing Figures

FIRE EXTINGUISHING APPARATUS FOR LARGE OIL STORAGE RESERVOIRS

The present invention relates to fire extinguishing apparatus, particularly but not exclusively for use in protecting the very large surfaces of hydrocarbon storage reservoirs in the form of sealed pits.

Extinguishing apparatus are known which consist of a reservoir, a duct provided with inhibitor fluid diffusers, and detector devices controlling the opening of a valve connecting the reservoir to the duct. These apparatus have the disadvantage that they require the use of a large number of detectors and diffusers, so that they are costly when used for protecting vast areas. Apparatus are also known in which the extinguishing fluid is contained under pressure in a tube of a thermoplastics material, which may or may not be connected to a reservoir, and which bursts to allow the pressurised fluid to escape, as soon as the temperature at a given point of the tube reaches a predetermined threshold value. These latter apparatus have the advantage of being simpler and less costly, but they are not suited to the protection of very large volumes and vast areas, as used in storage of petroleum products where the areas in question are at least several hundreds of square meters. In fact, the tube must satisfy several mutually incompatible criteria which do not allow the response time of the apparatus to be reduced below a particular threshold value. It will be appreciated that the response time must be as short as possible when the area to be protected is very large. In practice, the extinguishing product contained in the tube is in many cases corrosive, so that a corrosion resistant material for the tube must be selected, which material must also have sufficient mechanical strength, and consequently sufficient thickness, to avoid premature bursting, in spite of the internal pressure in the tube. This pressure must be relatively high to ensure efficient operation in case of fire, as the inhibitor product must be expelled quickly.

According to the present invention there is provided fire extinguishing apparatus comprising:

a reservoir for a fire inhibitor product under pressure;

a plastics tube which is adapted to burst when exposed to a predetermined temperature and is filled under pressure with a gas selected from the group comprising air and inert gases; and differential valve means connected to said reservoir and said plastics tube and which is normally closed, said differential valve means being adapted to open automatically to allow inhibitor product to pass from said reservoir to said plastics tube when a sudden drop in the gas pressure in said tube occurs.

Unlike the prior art devices, which require several detectors to trigger the discharge of the extinguisher product, or which use tubes acting both as detectors and extinguisher product containers, making the operating conditions delicate and the conditions for manufacturing and filling the tubes very strict, the invention uses a plastic tube e.g. a thermoplastics tube, only as a simple temperature rise detector until it burst and triggers the opening of a reservoir, the tube then only providing a channel for the extinguisher fluid. As a result, the thermoplastic tube can be of any suitable ordinary material. In fact, since the tube is only in contact with air or an inert gas before a fire is detected, there is no risk of corrosion and only the reservoir needs to be able to withstand chemical attack. Moreover, since the tube is subjected to the pressure of the inhibitor product for only a short period while the inhibitor product is flowing, and since this pressure in itself can be much lower than in the known apparatus, it will be appreciated that it is possible to use a tube able to withstand only low pressures, even at the triggering temperatures. A thin walled thermoplastics tube can thus be used, filled with a gas at a pressure of the order of 1.2 to 4 bars, depending on the selected operating temperature, the tube having the advantages that it is light, cheap and responds very quickly to the conditions for triggering opening of the reservoir at precise temperatures and with great reliability. Particularly when the extinguisher apparatus cannot be regularly checked, said plastics tube may be permanently connected to a pressurised reservoir of air of inert gas, via a capillary tube for maintaining the pressure in the tube.

In this way, even if the pressure in the plastics tube tends to decrease due to minor leaks, the capillary tube supply circuit constantly keeps up the operating pressure. This circuit does not affect the opening of the inhibitor reservoir, however, as the opening is triggered by the sudden pressure drop in the detector tube, which cannot be compensated via the capillary tube. Correct operation of the apparatus is therefore maintained, provided there is no premature ageing of the detector tube.

The discharge pressure of the inhibitor product may be maintained constant by providing a pressure relief valve in association with the differential valve means.

Thus after the detection phase, the tube will receive inhibitor fluid at a relatively low and constant pressure depending only on predetermined factors, the tube having to withstand only pressures of the order of 3 to 5 bars, for example, during the extinguishing period.

The advantages of use of the invention are not limited to accuracy, reliability, and reduced cost, but extend to the efficiency of the device, even in the protection of vast areas.

In fact, as the tube is no longer subject to relatively high pressures during detection and discharge, it can be made very long and to follow any required path without risk of deformation, the mechanical stresses due to pressure alone always being small. More particularly, as the tube is light due to the fact that it no longer contains any liquid, it can be spread over relatively light membranes covering petroleum products stored in natural or artificial pits, and a number of tubes can be grouped in a network, each group of tubes being maintained pressurised by common respective reservoir and each tube being connected to its own reservoir of inhibitor product through differential valve means.

The invention will be more fully understood from the following description of an embodiment thereof, given by way of example only, with reference to the accompanying drawings.

Figure 1:
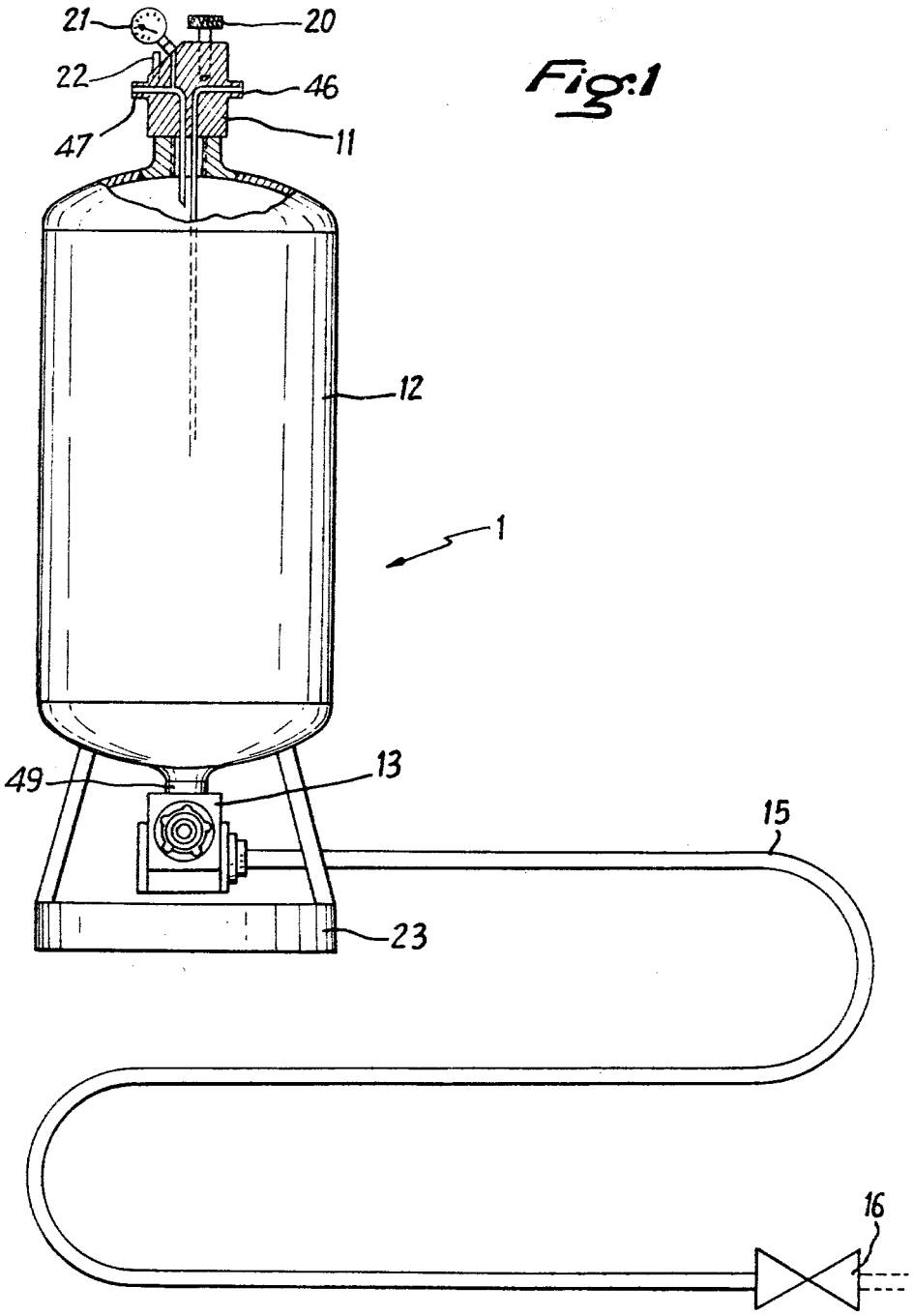
FIG. 1 is a diagrammatic view of an embodiment according to the invention with part of the apparatus cut away.

Referring to FIG. 1, the extinguisher apparatus 1 comprises a reservoir 12 for a fire inhibitor fluid and in the form of a metal enclosure, discharge means including a differential valve 13 which normally shuts off the reservoir, and a flexible tube 15 which is connected to valve 13, is normally filled with an inert gas and/or air and can be destroyed by heat, the free end of the tube 15 being either closed or connected through a valve 16 to a device for compensating for any loss of the gas which fills the tube 15, which is at a pressure of the order of 1.2 to 4 bars.

In the embodiment shown, the reservoir 12 has a filler cap 11 at the top and a base 23.

The filler cap 11 has a cock 20 for filling the reservoir 12 with inhibitor fluid which is introduced via a tube 46, and a cock 22 for introducing nitrogen via the tube 47 for pressurising the inhibitor fluid. A pressure gauge 21 shows the pressure to which the inhibitor fluid is pressurised. This pressure, which forces out the extinguisher product, is of the order of 7 to 15 bars, the vapour pressure of the product being, for example, of the order of 2 to 3 bars at normal temperatures.

Figure 2:
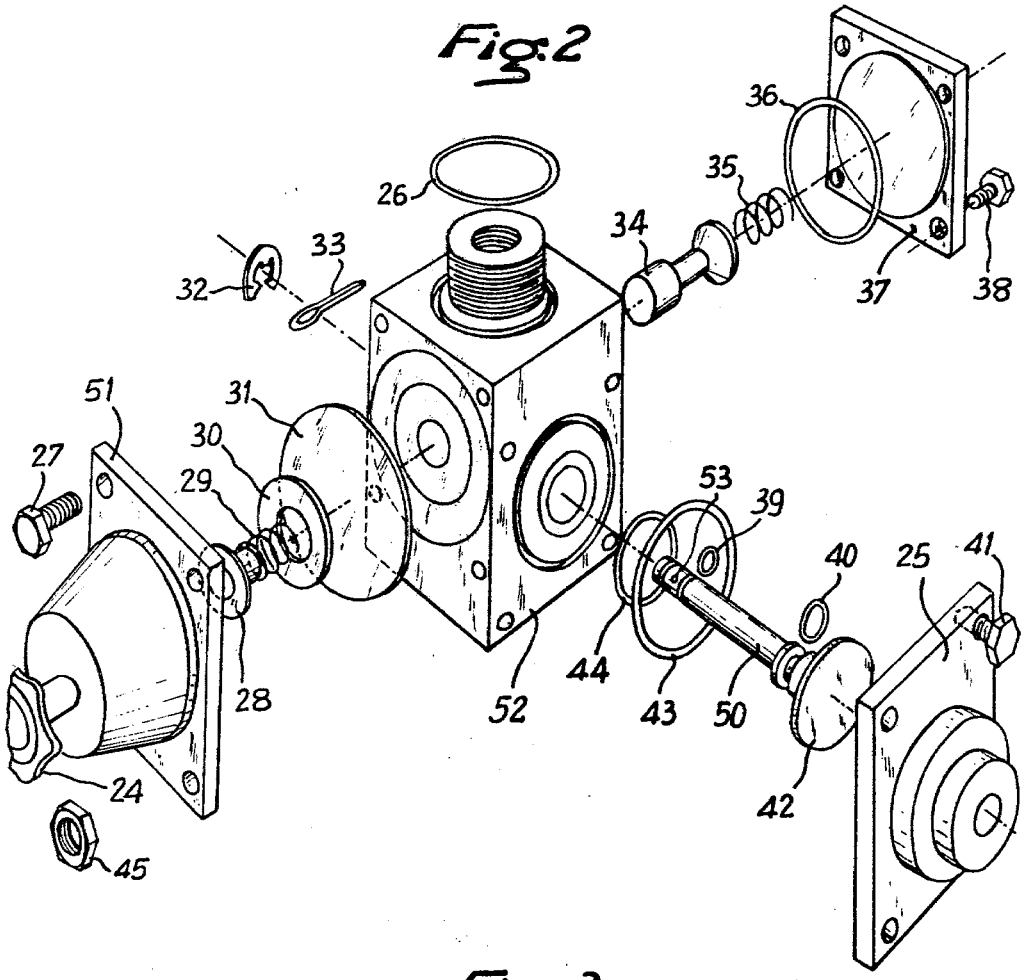
FIG. 2 is an exploded view of the differential valve means of the embodiment of FIG. 1.

The differential valve 13 is attached to a boss at the bottom of the reservoir 12. As shown in FIG. 2, it includes a casing 52 which is screwed to the reservoir 12, an O-ring 26 providing a seal. A differential valve member 42 controlling the discharge from reservoir 12 is normally pressed against the corresponding wall of the casing 52 via an O-ring 44. The discharge slide 50 of the valve 42 is fitted with O-rings 39 and 40 with different diameters. The travel of the slide is limited by a circlip 32 fixed to the free end of the slide 50, and discharge can be prevented by means of a split pin which can be lodged in a hole 53 in the slide. The valve member 42 is located in a cover 25 which is attached to the casing 52 by screws 41, an O-ring 43 providing a seal.

During discharge of inhibitor fluid as a result of movement of the valve member 42, its pressure is kept at a preset value by a pressure reducing valve regulation device including a throttling valve member 34 acted on by a return spring 35 which also bears against the cover 37. The cover 37 is attached to the casing 52 by screws 38, an O-ring 36 providing a seal. The valve 34 bears on a flexible regulator membrane 31 on the opposite side of which bears a retaining spring 29, via a washer 30. The force exerted by the spring 29 is controlled by a stop 28 which is adjustable in position by means of a bolt 24 which can be locked in place with a locknut 45. A cover 51 carrying the adjustment bolt 24 is attached to the casing 52 by screws 27.

When the tube 15 is located in the place to be protected and filled with an inert gas at the required pressure, if the temperature of the tube at any point along the length thereof reaches the predetermined value for which the tube was selected, the tube will burst at that point. The sudden drop in pressure in the tube frees the valve 42 which lodges in the housing in the cover 25 under the action of the pressure exerted by the inhibitor fluid on the area defined in the difference between the outside diameters of the bores receiving the slide 50 and limited by the two O-rings 39 and 40. The inhibitor fluid then flows through the free space around the valve 42, into the tube 15 and along the tube to the place where the tube burst.

If the discharge pressure in the casing 52 is too low, the spring 29 pushes back the membrane 31 and the valve 34 to a new position of the valve 34 permitting a greater quantity of the inhibitor fluid to be admitted and the pressure to increase. On the other hand, if the pressure of the inhibitor fluid increases beyond a given value, the valve 34 is moved to reduce the flow. The travel of the valve is preferably made very short, the resonant frequency of the assembly being relatively high.

Figure 3:
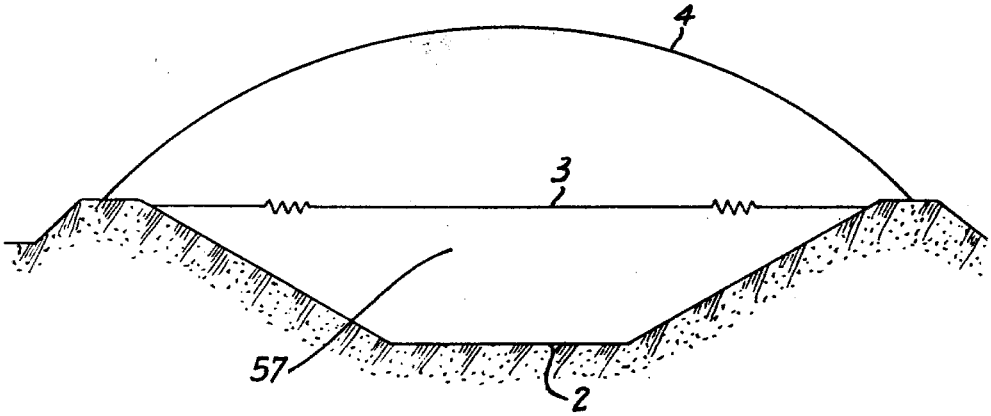
FIG. 3 is a diagrammatic cross-section of a reservoir for the storage of petroleum products.
Figure 4:
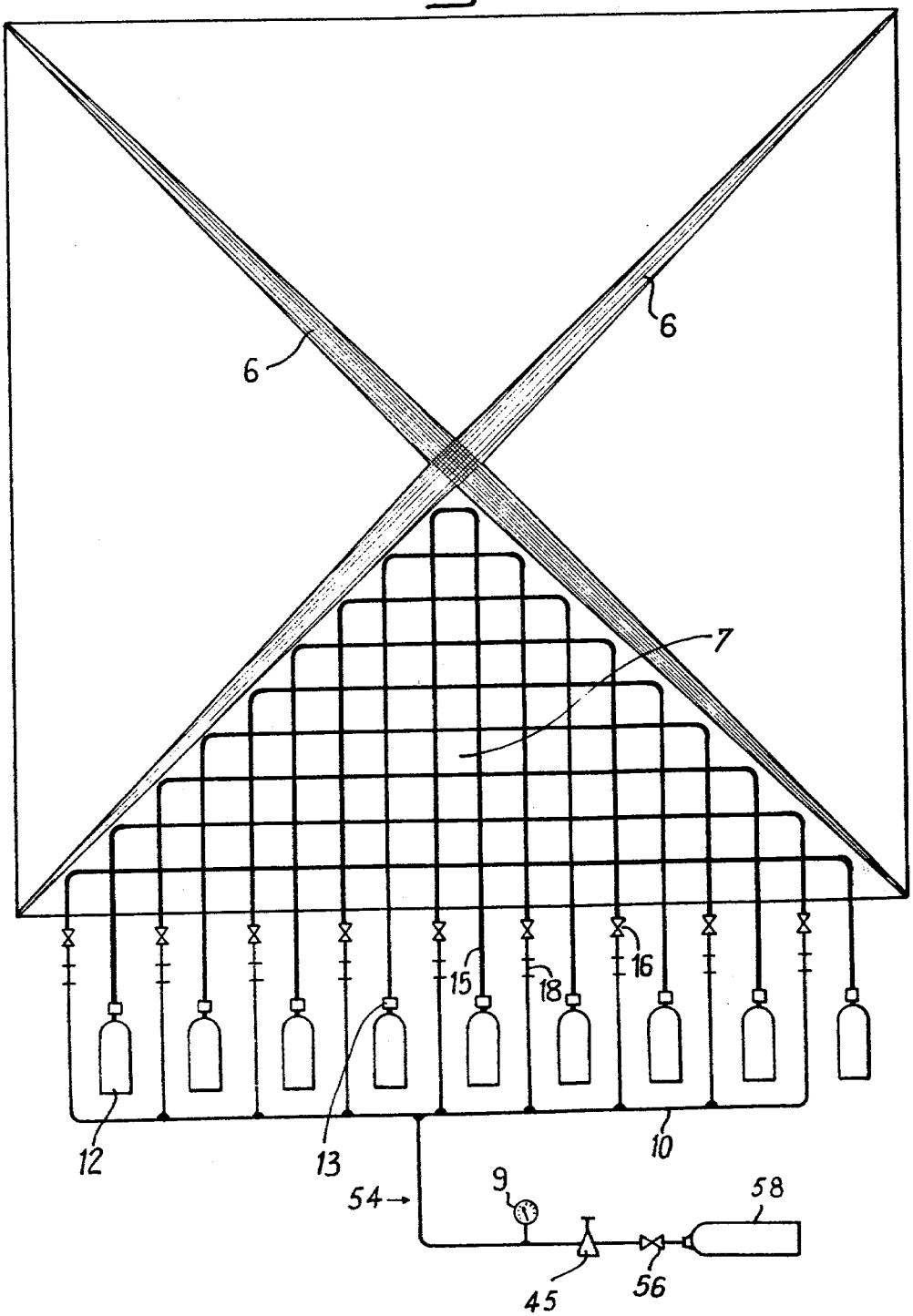
FIG. 4 is a diagrammatic plan view of a membrane protecting the surface of the product stored in the reservoir of FIG. 3, and provided with an extinguisher apparatus installation according to the present invention.

When an installation is likely to be rarely checked, the detector tube 15 is connected to a device for compensating for leaks, enabling a predetermined pressure to be maintained in the tube. A device of this type is shown in FIG. 4, which shows an apparatus as described above but adapted to the protection of a vast area 3 which is also shown in FIG. 3.

Figure 6:
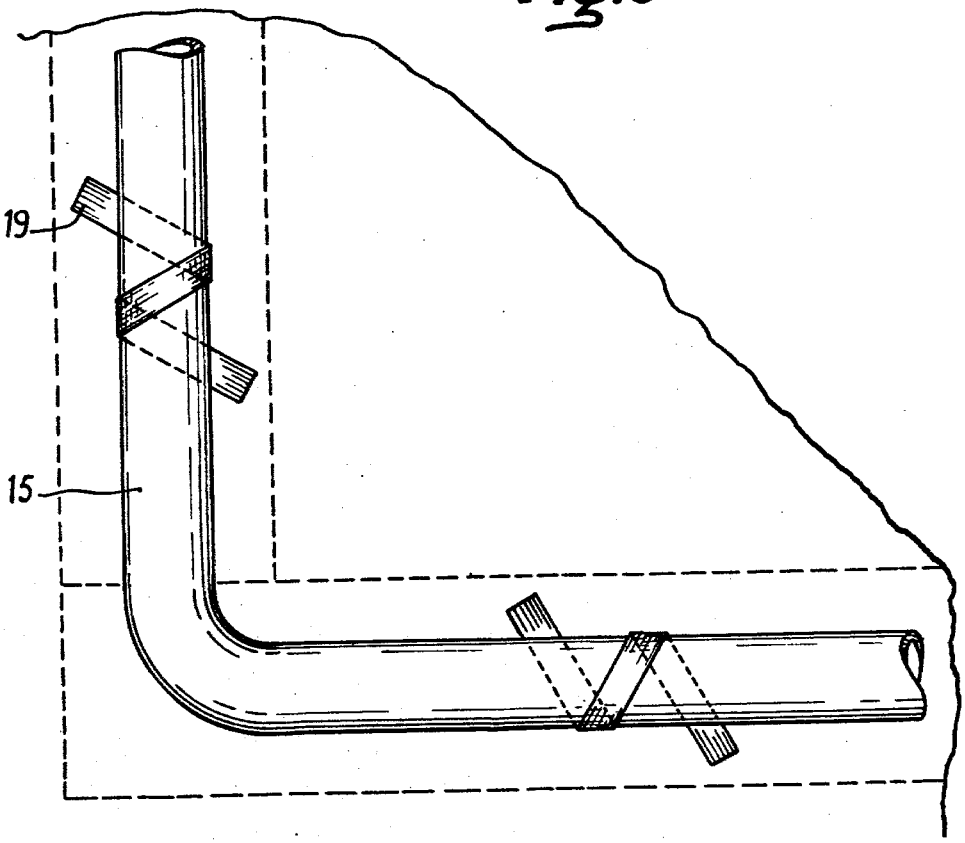
FIG. 6 is a plan view of part of the tube of the apparatus of FIG. 4 on the membrane.

The area 3 is a flexible membrane covering liquid hydrocarbon 57 stored in a trench 2, a roof 4 protecting the whole. As storage reservoirs of this type can be very large, it will be supposed that the width of a mesh formed by four portions of the tube 15, of which at least two belong to different tubes, is of the order of 2 to 5 meters. In the arrangement under consideration, nine reservoirs 12 are provided each controlled by a respective differential valve means 13 actuated by the sudden drop in the pressure of gas contained in the associated detector tube 15, the end of each of which is connected to a valve 16 which is opened after connection of the valve to a common compensation device 54 via individual capillary tubes 18. The tubes 18 are themselves connected to a common pipe 10. The device 54 includes a pressure gauge 9, a pressure reducing valve 45 and a valve 56 controlling the opening of a pressurised gas reservoir 58. The tubes 15 may be attached to the membrane 3 by strips 19 (FIG. 6) which can be glued or stapled to the membrane 3.

Figure 5:
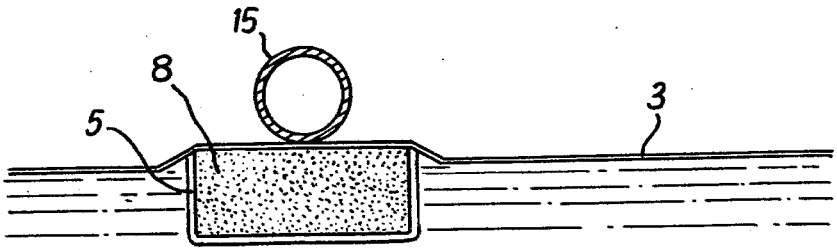
FIG. 5 shows a cross-section of a tube of the apparatus of FIG. 4 disposed on the membrane.

In the arrangement under consideration, the flexible membrane 3 may be stiffened by a grid arrangement of polyurethane foam bars 8 (FIGS. 5 & 6) glued to the membrane or slipped into pockets 5. As shown in FIG. 4, the extinguisher apparatus are arranged to protect one quarter of the area of the reservoir, each quarter being of triangular shape and bordered on two edges by a flexible zone 6. Similar arrangements protect the other three quarters.

The tubes 15 can be any suitable thermoplastics material.

Since each detector tube 15 is not in long term contact with the inhibitor fluid, the latter may be a stable and relatively non-toxic product such as bromochlorodifluoromethane or bromodifluoromethane or any other suitable product, corrosive or otherwise.

It will be clear that the device 13 for controlling the discharge of the extinguishing product can be of a different type to that described above. Likewise, for protecting large areas by means of a network of tubes forming a grid of any design, e.g. square or triangular, it will be clear that the tubes can be grouped in other arrangements. Thus in the case of cylindrical reservoirs with floating roofs, which can vary in height, a single tube can be disposed in the annular compartment of rectangular cross-section, for example, which holds the sealing ring for the circular roof, the reservoir and its valve being mounted on the roof itself.

What is claimed is:

1. Fire extinguishing apparatus comprising:

a plurality of reservoirs for storing a fire inhibitor product under pressure;

a plurality of thin wall plastic tubes filled with a gas selected from the group comprising air and inert gases at a pressure in the range of 1.2 to 4 bars, and tubes adapted to burst when exposed to a predetermined temperature and having a wall thickness selected to withstand the pressure of the inhibitor product only during flow therethrough;

a plurality of differential valve means individually connecting said plastic tubes to said reservoirs and which are normally closed, each differential valve means adapted to open automatically to allow inhibitor product to pass from a reservoir to an associated plastic tube when a sudden drop in gas pressure in said tube occurs upon bursting, and a plurality of capillary tubes individually connecting said thin wall plastic tubes to a single device for compensating for leaks from the tubes.

2. Apparatus as claimed in claim 1, wherein the material of each tube is selected so that it will withstand a pressure of three to six bars during fire fighting.

3. Apparatus as claimed in claim 1, including a flow regulating pressure reducing valve means associated with each differential valve means to regulate flow of said inhibitor product in the associated tube at a predetermined pressure.

4. Apparatus as claimed in claim 3, in which the pressure provided by said flow regulating pressure reducing valve means is adjustable to vary said predetermined pressure.

5. Apparatus as claimed in claim 1, wherein said plastic tubes are arranged over an area to be protected in a network to form a mesh such that any point in the area is in the immediate vicinity of at least two independent plastic tubes.

6. Apparatus as claimed in claim 5, wherein said plastic tubes are disposed on a flexible membrane covering stored liquid to be protected.

7. Apparatus as claimed in claim 6, in which said plastic tubes are arranged above reinforcing bars supporting said membrane.

8. Apparatus as claimed in claim 7, wherein said reinforcing bars are located in pockets in said membrane.

9. Apparatus as claimed in claim 6, wherein said plastic tubes are attached to said membrane by strips.

10. Apparatus as claimed in claim 6, wherein said reservoirs and said compensating device are outside said membrane, said membrane being divided into zones each of which carries the detector tubes associated with said reservoirs, said zones being separated by pleated areas.

11. Apparatus as claimed in claim 1, wherein said reservoirs and said differential valve means are situated on the floating roof of a cylindrical storage reservoir, said plastic tubes being located inside the compartment of said roof carrying the seal therefor.

* * * * *